US008890503B2

(12) United States Patent
Kodama et al.

(10) Patent No.: US 8,890,503 B2
(45) Date of Patent: Nov. 18, 2014

(54) STEP-DOWN POWER SUPPLY CIRCUIT

(71) Applicant: Fujitsu Semiconductor Limited, Yokohama (JP)

(72) Inventors: Hiroto Kodama, Yokohama (JP); Akimitsu Tajima, Yokohama (JP); Hideaki Kondo, Sagamihara (JP); Osamu Moriwaki, Yokohama (JP)

(73) Assignee: Fujitsu Semiconductor Limited, Yokohama (JP)

( * ) Notice: Subject to any disclaimer, the term of this patent is extended or adjusted under 35 U.S.C. 154(b) by 200 days.

(21) Appl. No.: 13/679,087

(22) Filed: Nov. 16, 2012

(65) Prior Publication Data

US 2013/0162227 A1 Jun. 27, 2013

(30) Foreign Application Priority Data

Dec. 22, 2011 (JP) ..... 2011-282119

(51) Int. Cl.
*G05F 1/12* (2006.01)
*G05F 1/62* (2006.01)

(52) U.S. Cl.
CPC ..... *G05F 1/62* (2013.01)
USPC ..... 323/297; 324/713

(58) Field of Classification Search
USPC ..... 323/297, 298, 353, 354, 273; 327/538–543, 545, 546; 324/601, 713; 702/85, 107
See application file for complete search history.

(56) References Cited

U.S. PATENT DOCUMENTS

| | | | |
|---|---|---|---|
| 6,008,674 A | 12/1999 | Wada et al. | |
| 6,131,073 A | 10/2000 | Honda et al. | |
| 7,348,834 B2 | 3/2008 | Ito | |
| 7,554,305 B2 * | 6/2009 | Nunokawa et al. | 323/273 |

FOREIGN PATENT DOCUMENTS

| | | |
|---|---|---|
| JP | 09-330135 | 12/1997 |
| JP | 2005-148942 | 6/2005 |
| JP | 2009-087293 | 4/2009 |

OTHER PUBLICATIONS

CNOA—Office Action of Chinese Patent Application No. 201210510913.9, dated Apr. 21, 2014 with full English translation of the Office Action.
"Design of Analog CMOS Integrated Circuits: Applications," Maruzen Publ. (Mar. 2003), pp. 468-473, with English translation.

* cited by examiner

*Primary Examiner* — Adolf Berhane
*Assistant Examiner* — Afework Demisse
(74) *Attorney, Agent, or Firm* — Fujitsu Patent Center

(57) ABSTRACT

A power supply has first and second reference voltage sources; a step-down voltage generator, including a transistor supplied with a first voltage, a resistor string between the transistor and a second voltage, and an op-amp which controls the transistor, and outputting the voltage at a first node among nodes in the resistor string; switches, coupled to the nodes; a comparison circuit, which compares the voltage at a common node the switches coupling in common with the second reference voltage source; and a calibration control circuit, which selects any switch according to a comparison result to calibrate. During calibration, the calibration control circuit couples a second node among the nodes to a non-inverting terminal of the op-amp, and the first reference voltage source to an inverting terminal of the op-amp, and after calibration, couples the common node to the non-inverting terminal, and the second reference voltage source to the inverting terminal.

13 Claims, 9 Drawing Sheets

VDD1
CALIBRATED REFERENCE VOLTAGE SOURCE
102
109
VDD1
REFERENCE VOLTAGE SOURCE
101
Vbias2
CNTRL4
CNTRL3
Vbias1
110
111
103
104
VDD1
VDD1
105
Nn
Rn
Nn-1
Rn-1
Nn-2
Rn-2
N2
R2
N1
R1
Vbias1'
CNTRL2
SWn
SW(n-1)
SW(n-2)
SW(n-3)
SW2
SW1
106
Vtap
CNTRL1
108
CALIBRATION CONTROL CIRCUIT
VDD1
Vcomp
112
COMPARISON CIRCUIT
107
VDD2
LOAD CIRCUIT
113

STEP-DOWN POWER SUPPLY CIRCUIT

CROSS-REFERENCE TO RELATED APPLICATION

This application is based upon and claims the benefit of priority of the prior Japanese Patent Application No. 2011-282119, filed on Dec. 22, 2011, the entire contents of which are incorporated herein by reference.

FIELD

This embodiments relates to a step-down power supply circuit.

BACKGROUND

Recently, in order to achieve higher integration levels in semiconductor integrated circuits, the MOS transistors used and other elements have been miniaturized. In general, by miniaturizing MOS transistors, a low-voltage element is obtained with a lowered threshold voltage and gate voltage and a narrow MOS transistor operating voltage range. Hence a step-down power supply circuit is used in order to enable the low-voltage elements in the semiconductor integrated circuit to operate normally. Examples of step-down power supply circuits are given in Japanese Patent Application Laid-open No. 2005-148942 and Japanese Patent Application Laid-open No. H9-330135. A step-down power supply circuit steps down an external power supply voltage to generate a desired step-down voltage, which is supplied to the internal integrated circuit, and in addition controls the step-down voltage based on a reference voltage from an internal reference voltage generation circuit.

However, in the case of large variation in the reference voltage of the reference voltage generation circuit, the step-down voltage is calibrated using a voltage tester or the like connected to the semiconductor integrated circuit and the calibration data is stored in a memory of a calibration circuit. Hence, increased manufacturing costs result. On the other hand, in the case of using the reference voltage generation circuit with small variation of the reference voltage, the power consumption of the reference voltage generation circuit increases because a variation of the reference voltage and a power consumption of the reference voltage generation circuit are in a trade-off relationship in general.

SUMMARY

According to a first aspect of the embodiment, A step-down power supply circuit has first and second reference voltage source circuits, which generate prescribed reference voltages; a first step-down voltage generation circuit, including a transistor to the source of which a first voltage is supplied, a resistor string in which a plurality of resistors are connected in series and which is provided between the transistor and a second voltage, and an operational amplifier which controls the transistor, the first step-down voltage generation circuit generating a first step-down output voltage at a first node among the plurality of resistor-connecting nodes in the resistor string; a plurality of switches, connected to the plurality of resistor-connecting nodes respectively; a comparison circuit, which compares the voltage at a common node connected in common by the plurality of switches with the output voltage of the second reference voltage source circuit, while the plurality of switches are switched; and a calibration control circuit, which selects any one among the plurality of switches according to a comparison result of the comparison circuit to perform a calibration, wherein the calibration control circuit, during the calibration operation of the first step-down voltage generation circuit, connects a second node among the plurality of resistor-connecting nodes to a non-inverting input terminal of the operational amplifier, and connects the output of the first reference voltage source circuit to an inverting input terminal of the operational amplifier; and, the calibration control circuit, after the calibration of the first step-down voltage generation circuit, connects the common node to the non-inverting input terminal of the operation amplifier, and connects the output of the second reference voltage source circuit to the inverting input terminal of the operational amplifier.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Figure 1:
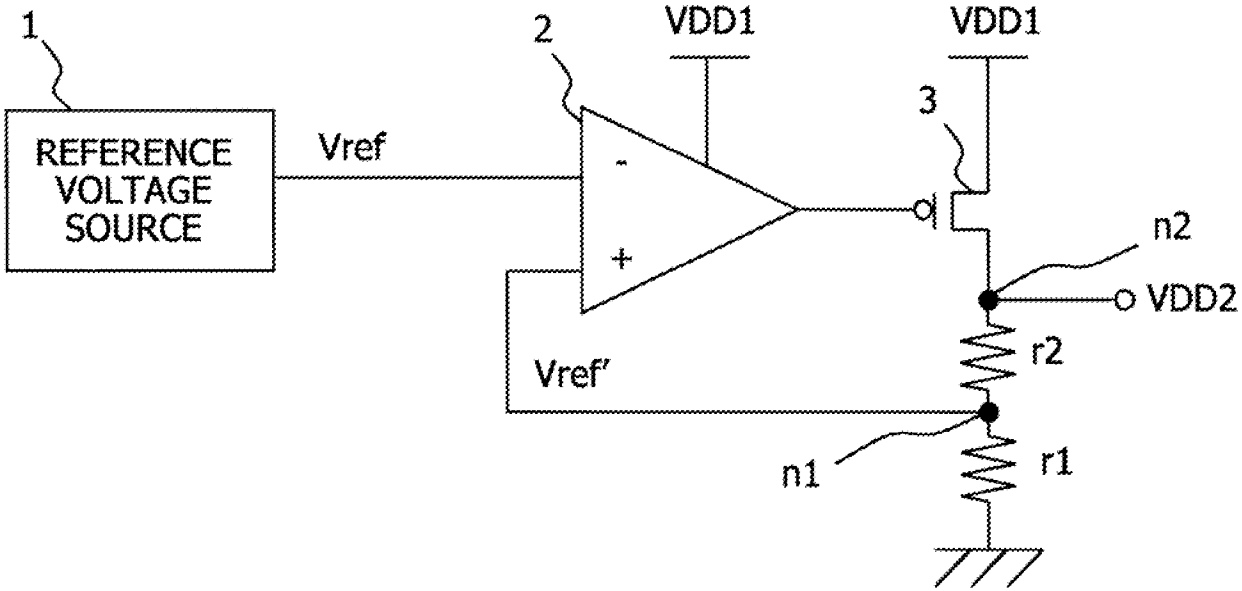
FIG. 1 illustrates a step-down power voltage generation circuit.

Below, embodiments are explained referring to the drawings.

FIG. 1 illustrates a step-down power voltage generation circuit. The step-down voltage generation circuit of FIG. 1 has a reference voltage source 1 which generates a reference voltage Vref; an op-amp 2; a PMOS transistor 3 the gate of which is connected to the output of the op-amp 2; and resistors r1 and r2. The inverting input terminal of the op-amp 2 is supplied with the reference voltage Vref, and the non-inverting input terminal is connected to a node n1 between the resistors r1 and r2; a voltage Vref is supplied to this node.

The op-amp 2 controls the gate voltage of the PMOS transistor 3 such that the voltage difference between the inverting input terminal and the non-inverting input terminal, that is, the voltage difference between the reference voltage Vref and the voltage Vref at node n1, vanishes, and changes the drain-source current of the PMOS transistor 3 according to the gate voltage. For example, when the voltage Vref at the node n1 is higher than the reference voltage Vref, the op-amp 2 raises the gate voltage of the PMOS transistor 3 and decreases the source-drain current, to lower the voltage Vref at the node n1. Conversely, when the voltage Vref at the node n1 is lower than the reference voltage Vref, the op-amp 2 lowers the gate voltage of the PMOS transistor 3 and increases the source-drain current, to raise the voltage Vref at the node n1. When the voltage Vref at the node n1 becomes equal to the reference voltage Vref (the state at this time is hereafter called the steady state), the gate voltage of the PMOS transistor 3 is held at a constant value. And, when the output voltage VDD2 changes according to a change in the current consumption of the circuit domain connected to the output voltage VDD2, the output voltage of the op-amp 2 changes based on the above-described operation. As a result a state is maintained in which the voltage Vref at the node n1 is equal to the reference voltage Vref, and the output voltage VDD2 is kept at a constant voltage.

Further, the output voltage VDD2 at the node n2 connecting the drain of the PMOS transistor 3 and the resistor r2 is determined by voltage division of the voltage Vref at the node n1 by the resistors r1 and r2. For example, in the steady state, the output voltage VDD2 can be expressed by Vref×(r1+r2)/r1.

When a reference voltage source 1 with low power consumption is used, there is large variation in the reference voltage Vref, and variation also occurs in the output voltage VDD2. Hence the output voltage VDD2 is calibrated while changing the resistance ratio of the resistances r1 and r2 using a voltage tester or the like, and increased manufacturing costs result. Conversely, when a reference voltage source 1 with small variation of the reference voltage Vref is used, the power consumption increases. Next, voltage source circuits which have low power consumption and generate low voltages with high precision are discussed.

First Embodiment

Figure 2:
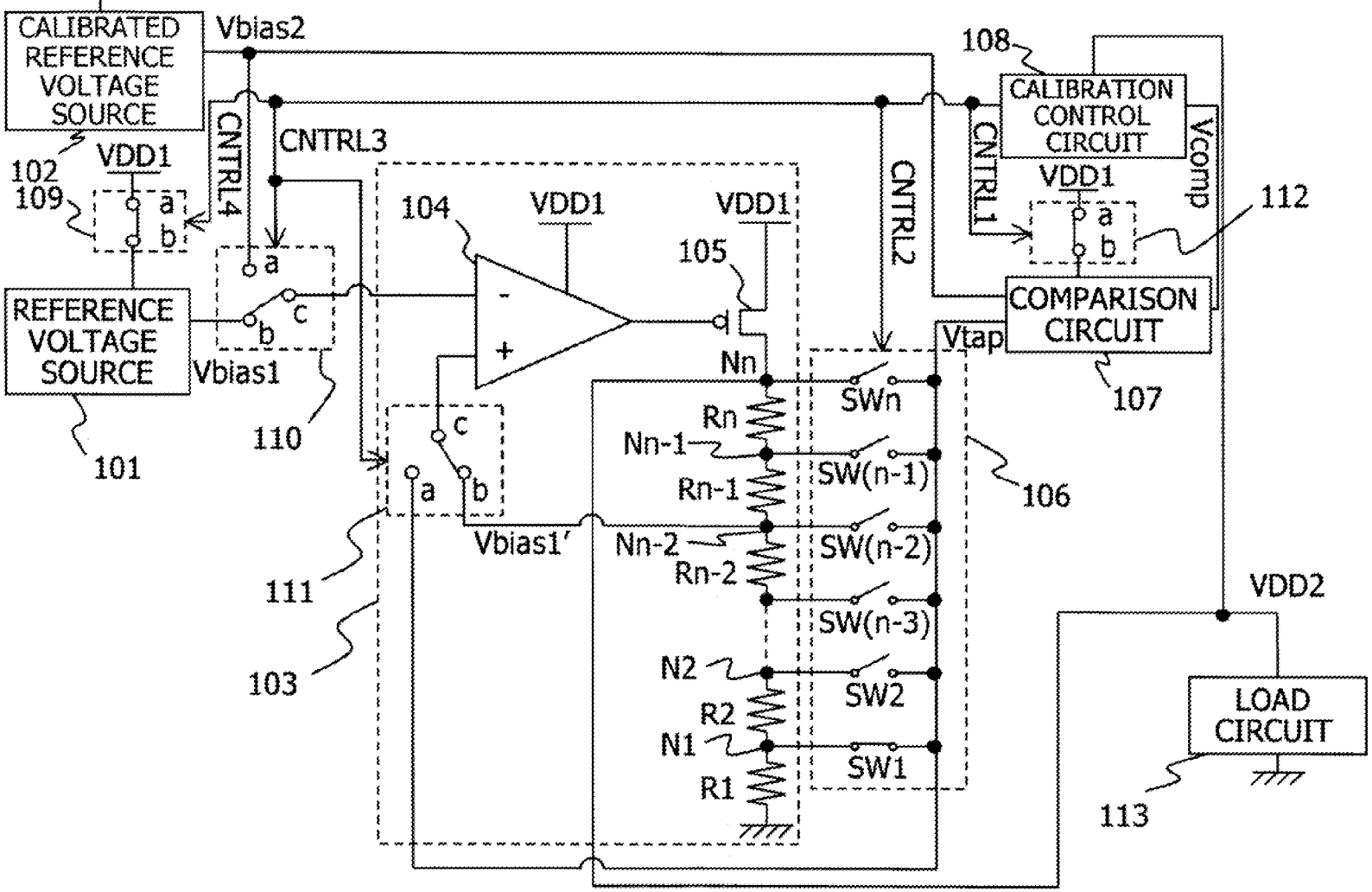
FIG. 2 illustrates the step-down power supply circuit prior to calibration in a first embodiment.
Figure 3:
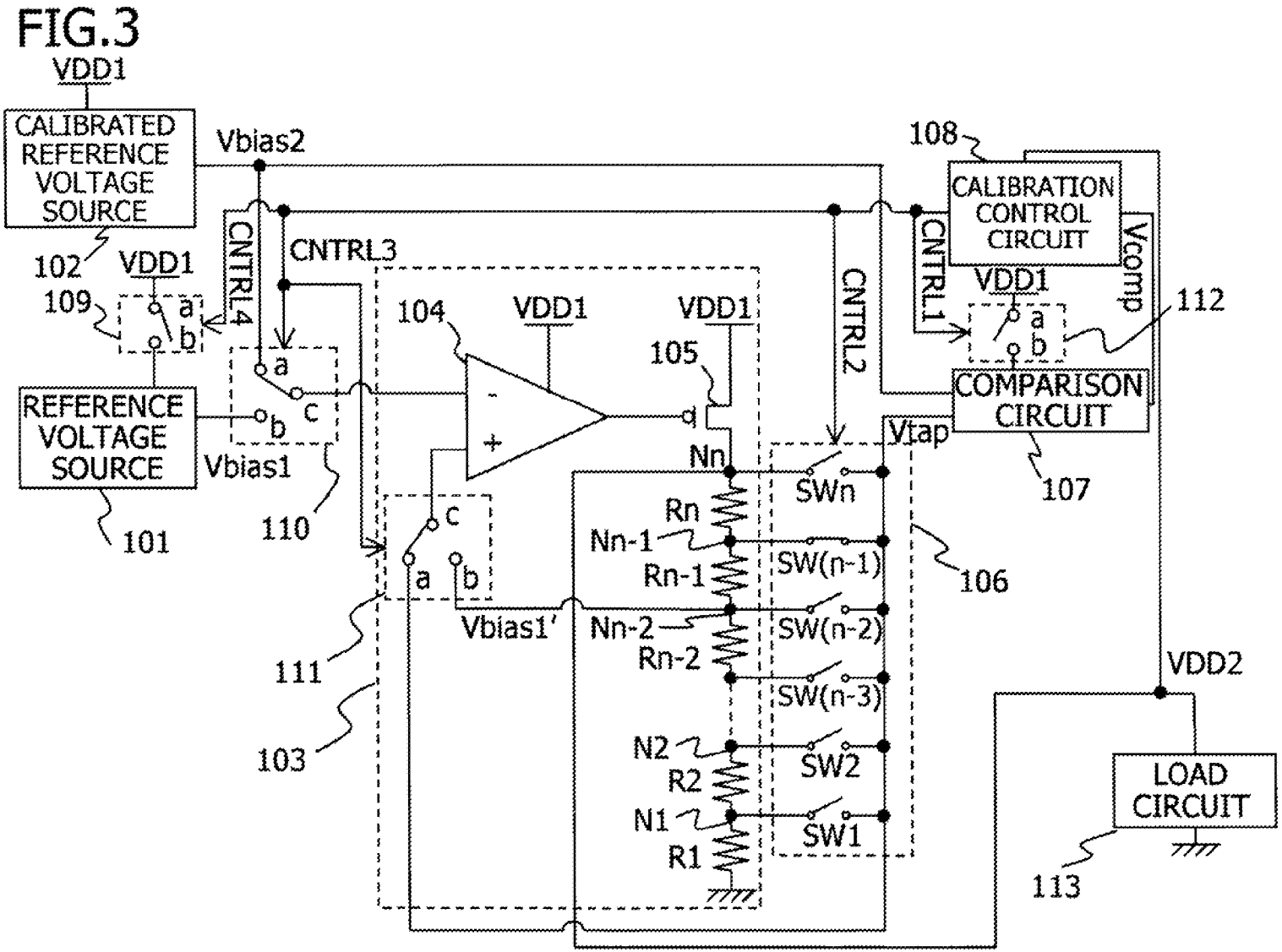
FIG. 3 illustrates the step-down power supply circuit after calibration in the first embodiment.
Figure 4:
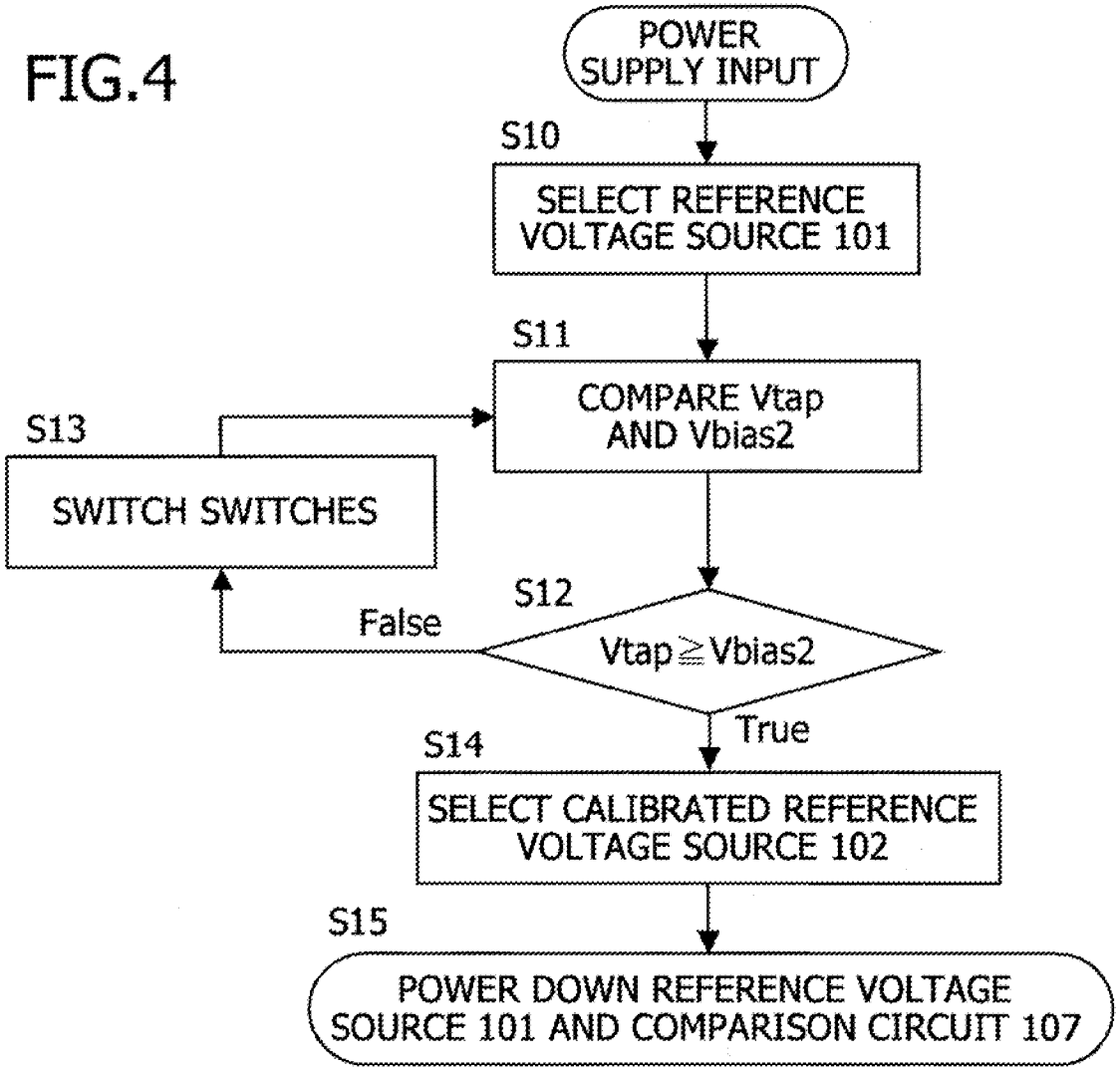
FIG. 4 illustrates the flow of calibration operation in the first embodiment.

FIG. 2 illustrates the step-down power supply circuit prior to calibration in a first embodiment. FIG. 3 illustrates the step-down power supply circuit after calibration in the first embodiment. FIG. 4 illustrates the flow of calibration operation in the first embodiment.

The step-down power supply circuit of FIG. 2 has a reference voltage source 101 (first reference voltage source circuit), which outputs a reference voltage Vbias1 with small variation but has high power consumption; a calibrated reference voltage source 102 (second reference voltage source circuit) which outputs a reference voltage Vbias2 with large variation but has low power consumption; a step-down voltage generation circuit 103 which generates a step-down voltage VDD2 based on the voltage supplied by the reference voltage source 101 or the calibrated reference voltage source 102; a comparison circuit 107 which, during calibration operation, compares the common node voltage Vtap output from the step-down voltage generation circuit 103 and the reference voltage Vbias2; and a calibration control circuit 108 which includes a low-voltage micro-element, and which controls calibration operation in response to the result of comparison by the comparison circuit 107. Here, for the variation of the reference voltage Vbias2 to be large means that the voltage variation occurring due to variation in the manufacture of elements of the calibrated reference voltage source 102 is large compared with the variation in voltage occurring due to variation in the manufacture of elements of the reference voltage source 101 which outputs the reference voltage Vbias1; as a result, relative to the reference voltage Vbias1 with the smaller voltage variation, the reference voltage Vbias2 is expressed by Vbias1±α (where α is the variation).

The step-down voltage generation circuit 103 has a resistor string of N resistors R1 to Rn connected in series; a PMOS transistor 105 to the source of which an external power supply voltage VDD1 is supplied and the drain of which is connected to the node Nn of the resistor string; and an op-amp 104, the inverting input terminal of which is supplied via a switch 110 with either a first reference voltage Vbias1 or a second reference voltage Vbias2, the non-inverting input terminal of which is supplied via a switch 111 with either a voltage Vbias1' obtained by voltage-dividing the voltage Vnn at the node Nn by the resistors (Rn+Rn-1) and the resistors (R1+ . . . +Rn-2) or the voltage Vtap at a common node, and the output of which is connected to the gate of the PMOS transistor 105. The voltages at the nodes between each of the resistors R1 to Rn are supplied, via the switch group 106, to the comparison circuit 107 as a common node voltage Vtap.

The reference voltage source 101, calibrated reference voltage source 102, comparison circuit 107, and op-amp 104 are supplied with the external power supply voltage VDD1. A switch 109 is provided between the external power supply voltage VDD1 and the reference voltage source 101, and a switch 112 is provided between the external power supply voltage VDD1 and the comparison circuit 107.

The step-down power supply circuit of FIG. 2 uses a reference voltage source with low power consumption, and has as an object the generation of a high-precision step-down voltage. First a high-precision reference voltage source 101 is used to generate a high-precision step-down voltage VDD2 using the step-down voltage generation circuit 103. Hereafter this is called Phase 1. Next, calibration of the calibrated reference voltage source 102 is performed with the reference voltage Vbias1 of the reference voltage source 101 as reference, and the node among the connection nodes N between the plurality of resistors in the resistor string at which the voltage is equal to the reference voltage Vbias2 of the calibrated reference voltage source 102 is identified. Hereafter this is called Phase 2. The inverting input terminal of the op-amp 104 is then connected to the calibrated reference voltage source 102 and is supplied with the low-precision reference voltage Vbias2, and moreover the node equal to the reference voltage Vbias2 is connected to the non-inverting input terminal. As a result, switching to the calibrated reference voltage source 102 is possible while maintaining the state of the op-amp 104. Hereafter this is called Phase 3. Then, the switch 109 is turned off and the current consumption of the reference voltage source 101 is shut off.

In this way, in the normal state after calibration operation, the step-down power supply circuit can use the calibrated reference voltage source 102 with low power consumption to generate the step-down voltage VDD2. Further, the fact that the low step-down voltage VDD2 is held at a constant value through the operations of Phase 1 through Phase 3 enables supply of the step-down voltage VDD2 as a power supply voltage to the calibration control circuit 108 including low-voltage miniaturized elements. Below, operation of the step-down power supply circuit in Phase 1 through Phase 3 is explained in detail, together with the flowchart of FIG. 4.

(Phase 1)

At the start of calibration operation, the switch 109 connects terminals a and b, the external power supply voltage VDD1 is input to the reference voltage source 101, and the reference voltage Vbias1 is generated. Further, the switch 110 connects the terminals b and c, and the reference voltage Vbias1 from the reference voltage source 101 is input to the inverting input terminal of the op-amp 104 (S10 in FIG. 4). On the other hand, the switch 111 connects the terminals b and c, and the voltage Vbias1' of the node Nn-2 between the resistors Rn-1 and Rn-2 is input to the non-inverting input terminal of the op-amp 104. Through these connections, the op-amp 104 controls the transistor 105, and the voltage Vbias1' of the node Nn-2 is made equal to the high-precision reference voltage Vbias1 applied to the inverting input terminal. As a result the voltages at the nodes other than the node Nn-2 are voltages higher than or lower than the reference voltage Vbias1. The voltages at each of these nodes are high-precision voltages, and the step-down voltage VDD2 at node Nn supplied to the load circuit 113 as a power supply voltage also has high precision.

Thus in Phase 1, by making the reference voltage supplied to the op-amp 104 the high-precision reference voltage Vbias1, the step-down voltage generation circuit 103 can generate a high-precision step-down voltage VDD2.

(Phase 2)

In Phase 2, a search is performed for a node of the resistor string at which a voltage is being generated equal to or approximating the reference voltage Vbias2 with large variation. First, in response to a switch control signal CNTRL1 of the calibration control circuit 108, the switch 112 connects the terminals a and b, and the external power supply voltage VDD1 is supplied to the comparison circuit 107. Further, in response to a switch control signal CNTRL2, the switch group 106 turns on the switch SW1 connected to the node N1 between the resistors R1 and R2, and the voltage at the node N1 is supplied to the comparison circuit 107 as the common node voltage Vtap.

In this state, the comparison circuit 107 compares the common node voltage Vtap and the reference voltage Vbias2. In this calibration operation example, among the nodes in the resistor string, a search is performed for a node with voltage equal to or approximating the reference voltage Vbias2 in order from the node N1 with lowest voltage to the node Nn with the highest voltage. That is, first a determination is made as to whether the voltage at node N1, the difference with the reference voltage Vbias1 of which is largest, and which is the lowest voltage, is Vbias2 (S11 in FIG. 4). At this time the voltage Vtap of the common node is expressed as Vbias1×R1/(R1+ . . . +Rn-2), obtained by voltage-dividing the node voltage Vbias1' (=Vbias1) of the node Nn-2. As a result of comparison (S12 in FIG. 4), when "common node voltage Vtap<reference voltage Vbias2", H level is output, and when "common node voltage Vtap≥reference voltage Vbias2", L level is output as the determination signal Vcomp.

Based on the determination signal Vcomp output by the comparison circuit 107, the calibration control circuit 108 outputs switch control signals CNTRL1 to 4 to control operation of the switch group 106 and the switches 109 to 112.

Because the voltage at the first node N1 is lowest, the determination signal Vcomp is set to H level, that is, "common node voltage Vtap<reference voltage Vbias2". In response to this, the calibration control circuit 108 outputs the switch control signals CNTRL2 to the switch group 106, and after the switch SW1 within the switch group 106 is turned off, the switch SW2 is turned on (S13 in FIG. 4).

Then, the voltage at the node N2 (=Vbias1×(R1+R2)/(R1+ . . . +Rn-2)) is supplied to the comparison circuit 107 as the common node voltage Vtap, and is compared with the reference voltage Vbias2. If, as the comparison result (S12 in FIG. 4), the determination signal Vcomp is again at H level, that is, "common node voltage Vtap<reference voltage Vbias2", the switch control signal CNTRL2 is again output from the calibration control circuit 108, causing the switch SW2 in the switch group 106 to be turned off and the switch SW3 to be turned on (S13 in FIG. 4).

In this way, switching of the switches is performed in the order switch SW1, SW2, . . . , SW(n-3), SW(n-2), SW(n-1), SWn, from lower to higher. That is, switches are switched such that the difference between the common node voltage Vtap and the reference voltage Vbias2 becomes smaller. Switching of switches and comparison of the common node voltage Vtap and the reference voltage Vbias2 are performed until the determination signal Vcomp changes from H level to L level, that is, until the comparison result is "common node voltage Vtap≥reference voltage Vbias2". That is, comparison is repeated until a node is found the voltage at which is equal to or substantially equal to the reference voltage Vbias2.

Even when switching is performed, the op-amp 104 controls the transistor 105 and causes the voltage Vbias1' at the node Nn-2 to be equal to the reference voltage Vbias1, so that there is no change in the voltages at each of the nodes of the resistor string. Hence the step-down voltage VDD2 also does not change, and is held at a constant value.

Here, suppose that as a result of switch switching (S13 in FIG. 4) the switch SW(n-1) connected to the node Nn-1 is turned on, and the comparison result (S12 in FIG. 4) has changed to "common node voltage Vtap≥reference voltage Vbias2". That is, it is assumed that a place having a voltage equal to the reference voltage Vbias2 exists between the node Nn-1 and the node Nn-2. The voltage differences between nodes is determined by the resistors R1 to Rn, but in the first embodiment, it is assumed that the resistors are set such that the voltage at the node Nn-1 is substantially equal to the reference voltage Vbias2. Hence the voltage at the node Nn-1 is represented by Vbias1×(R1+ . . . +Rn-1)/(R1+ . . . +Rn-2)≅Vbias2.

When the comparison result changes from "common node voltage Vtap<reference voltage Vbias2" to "common node voltage Vtap≥reference voltage Vbias2", the determination signal Vcomp output from the comparison circuit 107 changes from H level to L level.

Thus in Phase 2, switches in the switch group 106 are switched, the voltage at each node is compared with the low-precision reference voltage Vbias2, and the node having a voltage equal to the reference voltage Vbias2 is identified.

(Phase 3)

When the determination signal Vcomp changes from H level to L level, the calibration control circuit 108 outputs switch control signals CNTRL1, CNTRL3 and CNTRL4 so as to control the switches as follows. That is, the switches 110 and 111 connect the terminal a and the terminal c, respectively, according to the switch control signal CNTRL3 (S14 in FIG. 4). In Phase 3, the reference voltage source 101 and the comparison circuit 107 are not used, so that the switch 109 is turned off by the switch control signal CNTRL4 and the switch 112 is turned off by the switch control signal CNTRL1 (S15 in FIG. 4). As a result, power consumption by the reference voltage source 101 and the comparison circuit 107 is halted.

As illustrated in FIG. 3, as a result of switching the switches 109 and 110 to 112, the inverting input terminal of the op-amp 104 and the calibrated reference voltage source 102 are connected, and the non-inverting input terminal and the node Nn-1 are connected. That is, the reference voltage supplied to the step-down voltage generation circuit 103 changes from the reference voltage Vbias1 of the reference voltage source 101 to the reference voltage Vbias2 of the calibrated reference voltage source 102, the low-precision reference voltage Vbias2 is supplied to the inverting input terminal of the op-amp 104, and the voltage of the node Nn-1 identified in Phase 2 is supplied to the non-inverting input terminal. The voltage of the node Nn-1 identified in Phase 2 is a voltage which is equal to or approximates the reference voltage Vbias2.

As a result, after switching of the switches 110 and 111, the voltage at the node Nn-1 is maintained at the reference voltage Vbias2 (≅Vbias1×(R1+ . . . +Rn-1)/(R1+ . . . +Rn-2)). Further, after switching of the switches 110 and 111, there is no change in the voltages at each of the nodes, and the step-down voltage VDD2 is also maintained at a high-precision value without changing. That is, in the normal operating state after Phase 3, even when the reference voltage Vbias2 from the reference voltage source 102 and with large variation is supplied to the step-down voltage generation circuit 103, a high-precision step-down voltage VDD2 can be output. Moreover, the power consumption of the reference voltage source 102 is low.

Thus through the step-down power supply circuit illustrated in FIG. 2 and FIG. 3, the power consumption of the reference voltage source can be reduced and a high-precision step-down voltage VDD2 can be generated. Further, a high-precision step-down voltage VDD2 is stably generated in Phase 1 to Phase 3, so that the step-down voltage VDD2 can also be supplied to the calibration control circuit 108, including low-voltage elements.

In the method of searching for a node the voltage of which is equal to the reference voltage Vbias2 in Phase 2, switching may also be performed in the order from the switch SWn to the switch SW1, from higher to lower. Further, in addition to this method, a bisection search method can be used to identify the node the voltage of which is equal to the reference voltage Vbias2.

Further, in FIG. 2 and FIG. 3, the node which outputs the step-down voltage VDD2 was taken to be the node Nn; but other nodes are possible, and the step-down voltage VDD2 can be output from any one of the nodes N1 to Nn, according to the power supply voltage for the load circuit 113 to which the step-down voltage VDD2 is to be supplied. Similarly, the node supplying the power supply voltage to the calibration control circuit 108 can be any one of the nodes N1 to Nn, according to the voltage for the calibration control circuit 108.

Further, in FIG. 2 the voltage at the node Nn-2 is supplied to the non-inverting input terminal of the op-amp 104. However, it is preferable that, depending on the direction of the variation of the reference voltage Vbias2, a node from the node Nn to the node N1 be selected and connected to the non-inverting input terminal of the op-amp 104, and in particular that the node the voltage of which is equal to the reference voltage Vbias2 be identified.

For example, normally the variation a in the reference voltage Vbias2 is expected to be confined within a prescribed range with reference to the reference voltage Vbias1, and so in Phase 1 the node Nn/2 which is in the center of the nodes of the resistor string is connected to the non-inverting input terminal of the op-amp 104, and in Phase 2 a search is performed for the node at which the voltage is equal to the reference voltage Vbias2. As a result of the search, when for example "voltage of node Nn<reference voltage Vbias2", one of the nodes below the node Nn/2 may be connected to the non-inverting input terminal of the op-amp 104, and execution may begin again from Phase 1. When "voltage at node N1>reference voltage Vbias2", one of the nodes above the node Nn/2 may be connected to the non-inverting input terminal of the op-amp 104, and execution may begin again from Phase 1.

Figure 5:
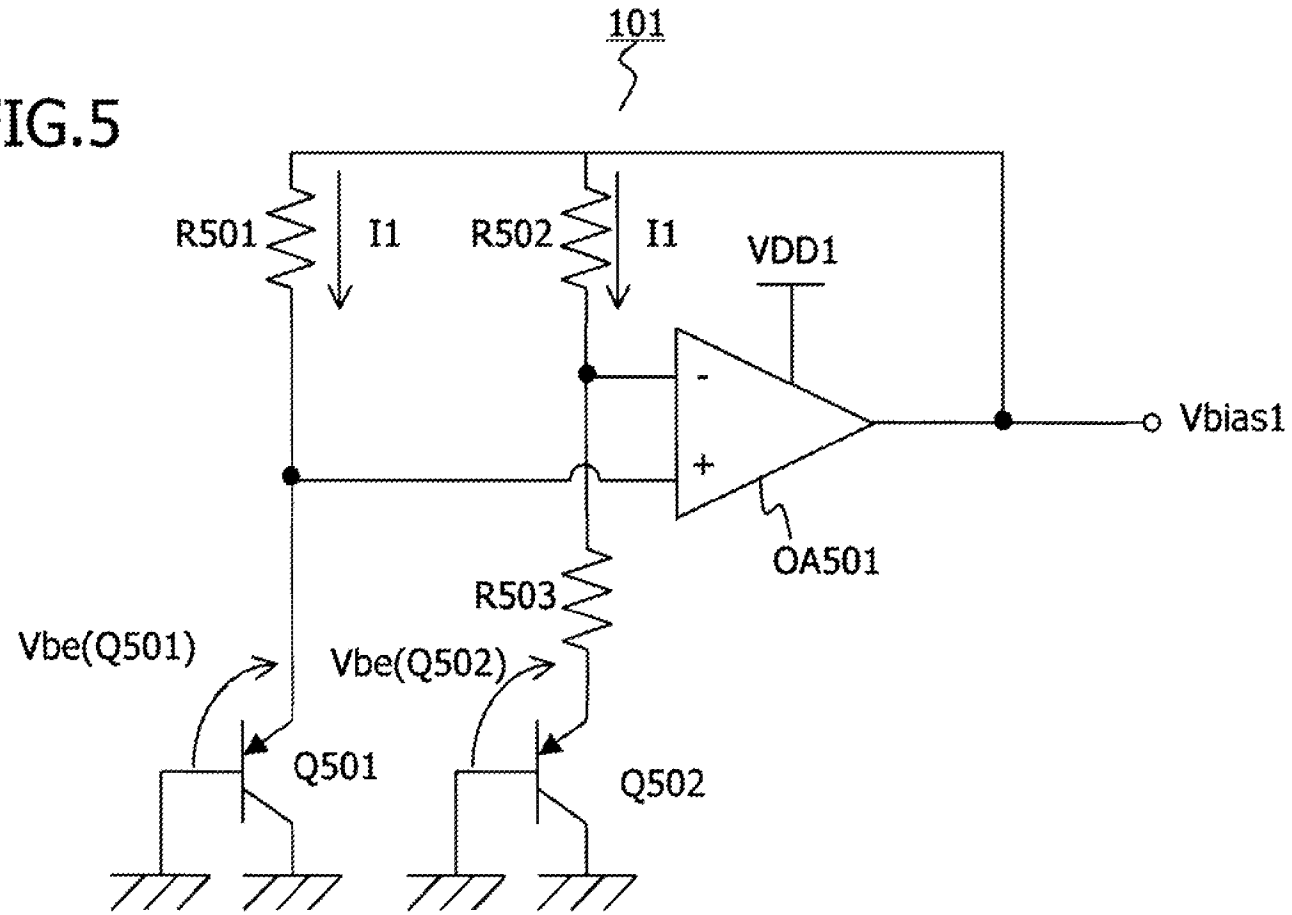
FIG. 5 illustrates the reference voltage source in the first embodiment.
Figure 6B:
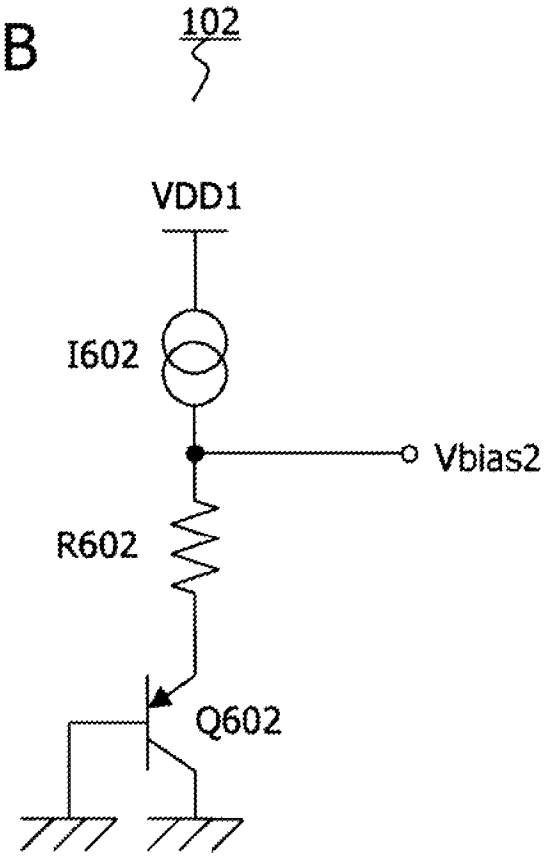
FIGS. 6A and 6B illustrate the calibrated reference voltage source in the first embodiment.
Figure 6A:
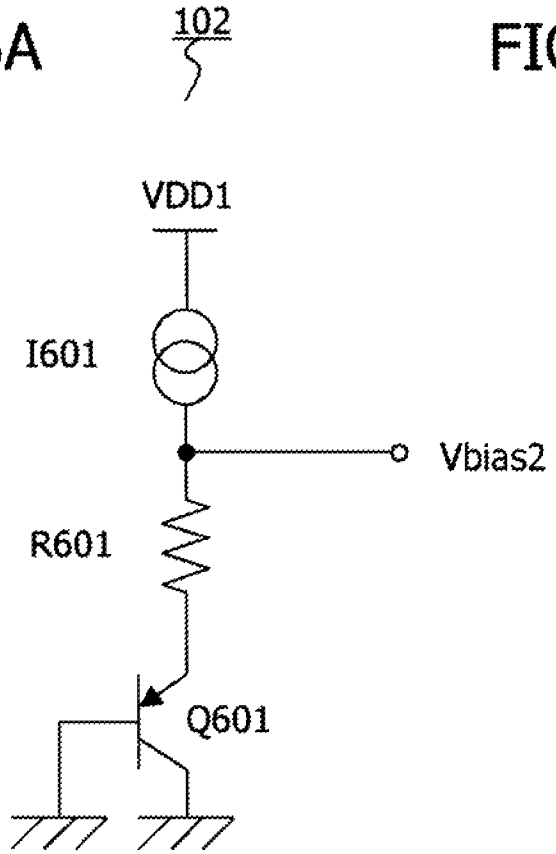
Figure 7:
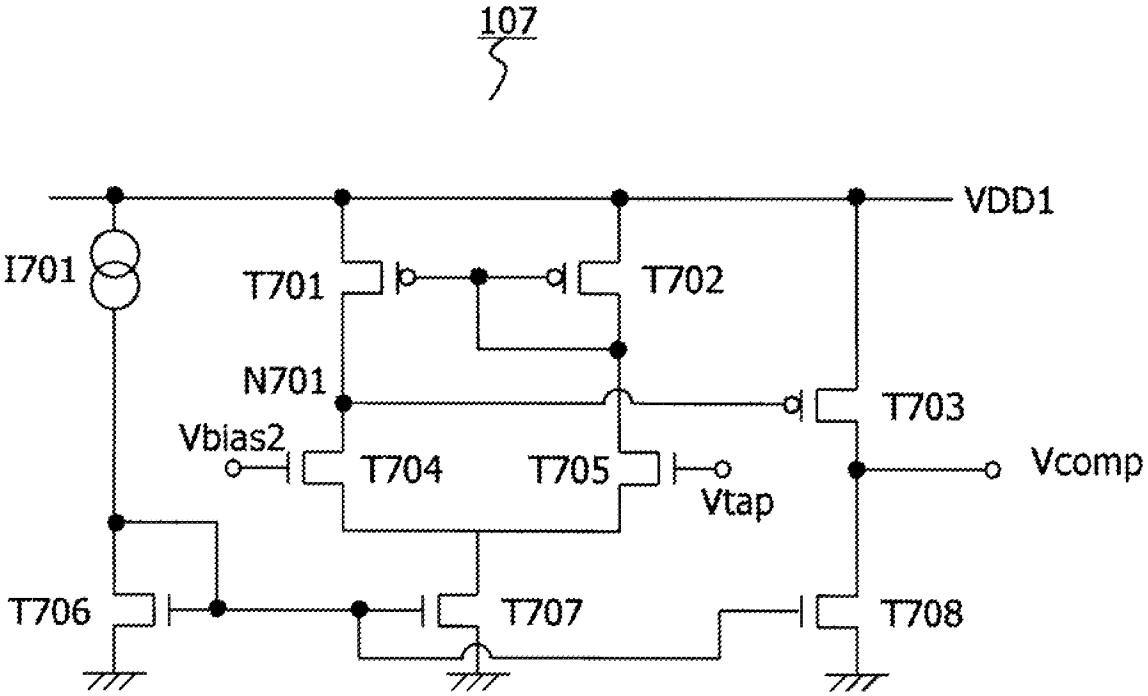
FIG. 7 illustrates the comparison circuit in the first embodiment.

Next, the circuit configuration of the reference voltage source 101, calibrated reference voltage source 102 and comparison circuit 107 of FIG. 2 and FIG. 3 is explained, using FIG. 5 to FIG. 7.

FIG. 5 illustrates the reference voltage source in the first embodiment. The reference voltage source 101 illustrated in FIG. 5 is a band gap circuit having an op-amp OA501, resistors R501 to R503, and bipolar transistors Q501 and Q502. For example, the bipolar transistor Q501 is a single unit transistor, and the bipolar transistor Q502 has n parallel-connected unit transistors.

The resistors R501 and R502 are designed to be equal. In the state in which the op-amp OA501 is stable, the voltages at the inverting input terminal and the non-inverting input terminal of the op-amp OA501 are equal, so that the same current flows in both resistors. As a result, the same current flows in the bipolar transistors Q501 and Q502, the current density is 1:1/n, and a difference in voltage ΔVbe occurs in the forward-direction voltages Vbe of the bipolar transistors Q501 and Q502 (Vbe(Q501)−Vbe(Q502)=ΔVbe). This voltage difference ΔVbe is applied to the resistor R503. That is, the current I1 flowing in the resistors R502 and R503 is ΔVbe/R503. Hence the reference voltage Vbias1 is the sum of the forward-direction voltage Vbe(Q501) of the emitter-base pn junction of the bipolar transistor Q501 (the voltage at the non-inverting input terminal of the op-amp OA501), and the voltage across R502, or R502×I1=ΔVbe×R502/R503.

Further, the forward-direction voltage Vbe(Q501) of the pn junction of the bipolar transistor has a negative temperature dependence such that the voltage declines with rising temperature, whereas the difference ΔVbe in the pn junction forward-direction voltages of the two bipolar transistors biased at different current densities has a positive temperature dependence, increasing in proportion to the temperature. As a result, the value of the reference voltage Vbias1 obtained by adding these does not depend on temperature, and it is known that the reference voltage Vbias1 is approximately 1.2 V (1200 mV), equivalent to the band gap voltage of silicon.

Further, as stated in Behzad Razavi et al, "Design of Analog CMOS Integrated Circuits: Applications", Maruzen publ., pp. 468-473, in order to raise the precision of the reference voltage Vbias1 in the band gap circuit, the number n of unit transistors in the bipolar transistor Q502 is large. The lower limit of current consumption of a unit transistor to provide desired functionality is determined by the device specifications, and so by using a large number n of unit transistors, the overall current consumption of the bipolar transistor Q502 becomes large. Hence the current flowing in the resistors R501 to R503 becomes large, and the current consumption of the band gap circuit as a whole is also large.

Thus the reference voltage source 101 generates a high-precision voltage Vbias1, but has high power consumption.

FIGS. 6A and 6B illustrate the calibrated reference voltage source in the first embodiment. In FIGS. 6A and 6B, two calibrated reference voltage sources 102 are illustrated.

The calibrated reference voltage source 102 of FIG. 6A has a current source 1601 which generates a PTAT (Proportional To Absolute Temperature) current, the current value of which rises in proportion to the temperature; a polysilicon resistor R601, the resistance value of which is constant and does not change with temperature; and a bipolar transistor Q601. The forward-direction voltage Vbe of the bipolar transistor Q601 has a negative temperature dependence, so that the voltage falls with rising temperature. On the other hand, the current of the current source I601 has a positive temperature dependence, rising with rising temperature, and thus the voltage across the resistor R601 has a positive temperature characteristic, rising with rising temperature. Hence the reference voltage Vbias2, which is the sum of the forward-direction voltage Vbe of the bipolar transistor Q601 and the voltage across the resistor R601, does not depend on temperature. However, the absolute values of the characteristics of the bipolar transistor Q601 and the resistor R601 change depending on manufacturing variations of the individual elements. Hence variation due to manufacturing variations also occurs in the value of the reference voltage Vbias2.

The calibrated reference voltage source 102 of FIG. 6B has a current source I602, which generates a constant current independent of temperature; a diffused resistor R602, the resistance value of which rises in proportion to the temperature; and a bipolar transistor Q602. The forward-direction voltage Vbe of the bipolar transistor Q602 has a negative temperature dependence, falling with rising temperature. Hence the reference voltage Vbias2, which is the sum of the forward-direction voltage Vbe of the bipolar transistor Q602 and the voltage across the resistor R602, does not depend on temperature. However, in FIG. 6B also, similarly to FIG. 6A, due to manufacturing variations in the bipolar transistor Q602 and the resistor R602, variations also occur in the reference voltage Vbias2.

Further, the currents of the current sources I601 and I602 in FIGS. 6A and 6B have the minimum current values so that the bipolar transistors Q601 and Q602 and the resistors R601 and R602 satisfy their specifications, and thus compared with the reference voltage source 101, the current consumption of the calibrated reference voltage source 102 is small.

As explained above, in the calibrated reference voltage source 102, power consumption is small, but variation in the reference voltage Vbias2 is large.

FIG. 7 illustrates the comparison circuit in the first embodiment. The comparison circuit 107 in FIG. 7 is supplied with the external power supply voltage VDD1, and has a current source I701, PMOS transistors T701 to T703, and NMOS transistors T704 to T708.

The NMOS transistors T706 to T708 form a current mirror circuit, and the drain currents of the NMOS transistors T706 to T708 are equal. The PMOS transistors T701 and T702 form a current mirror circuit, and the drain currents flowing in the PMOS transistors T701 and T702 are equal. And, the sources of the NMOS transistors T704 and T705 are connected in common, and the reference voltage Vbias2 and common node voltage Vtap are applied to their respective gates; the voltage level of the node N701 connected to the gate of the PMOS transistor T703 changes according to the difference between the reference voltage Vbias2 and the common node voltage Vtap. That is, the PMOS transistors T701 and T702 and the NMOS transistors T704 and T705 form a differential circuit which takes the reference voltage Vbias2 and the common node voltage Vtap as input voltages.

When the reference voltage Vbias2>common node voltage Vtap, the voltage level at the node N701 is low, the PMOS transistor T703 is turned on, and the determination signal Vcomp is at H level. When the common node voltage Vtap≥the reference voltage Vbias2, the voltage level at the node N701 is high, the PMOS transistor T703 is turned off, and the determination signal Vcomp is at L level. As illustrated in FIG. 2, the calibration control circuit 108 outputs switch control signals CNTRL1 to CNTRL4 based on this determination signal Vcomp.

In the above, the step-down power supply circuit of the first embodiment first outputs the reference voltage with small variation Vbias1, but supplies the reference voltage Vbias1 from the reference voltage source 101, with high power consumption, to the op-amp 104, and generates the step-down voltage VDD2 with high precision. And, while maintaining the voltages at each of the nodes in the resistor string and comparing the voltage at each node with the reference voltage Vbias2 with large variation, the node with voltage equal to the reference voltage Vbias2 is identified. Then, the reference voltage supplied to the op-amp 104 is switched from the high-precision reference voltage Vbias1 of the reference voltage source 101 with high power consumption to the low-precision reference voltage Vbias2 of the calibrated reference voltage source 102 with low power consumption. Further, by connecting the node with voltage equal to the reference voltage Vbias2 to the op-amp 104, the voltages of each node in the resistor string can be maintained after switching. As a result, the power consumption of the reference voltage source can be reduced and the step-down voltage VDD2 can be generated with high precision. Further, the step-down voltage VDD2 is kept constant through Phases 1 to 3, so that the step-down voltage VDD2 can be supplied to the calibration control circuit 108, which includes low-voltage elements.

Second Embodiment

Figure 8:
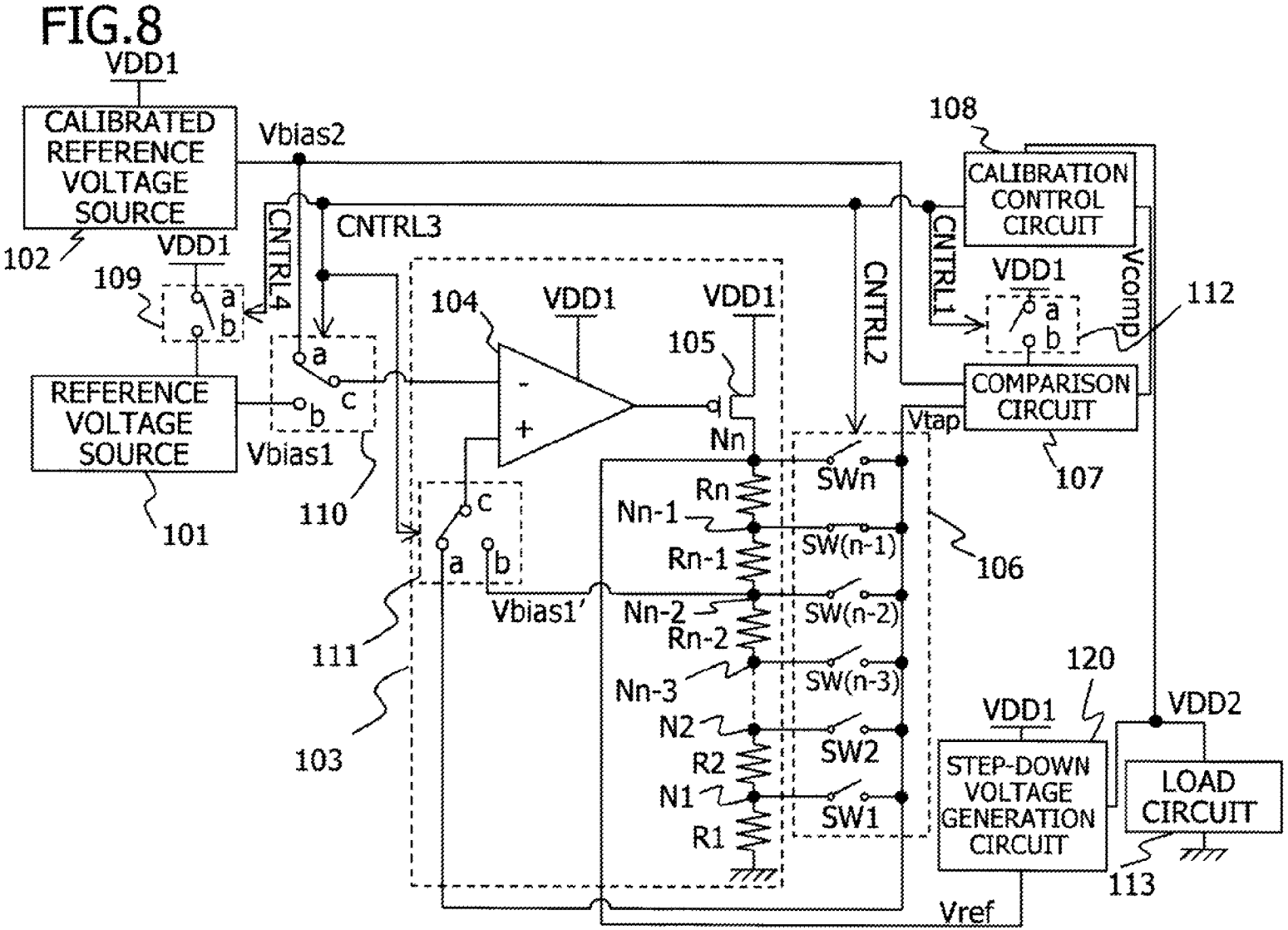
FIG. 8 illustrates the step-down power supply circuit of a second embodiment.

FIG. 8 illustrates the step-down power supply circuit of a second embodiment. Compared with the step-down power supply circuit of FIG. 2 and FIG. 3, the step-down power supply circuit of FIG. 8 also has another step-down voltage generation circuit 120 (second step-down voltage generation circuit); the step-down voltage VDD2 of the step-down voltage generation circuit 120 is supplied to the calibration control circuit 108 and load circuit 113 as a power supply voltage. The step-down voltage generation circuit 120 is assumed to be the step-down voltage generation circuit of FIG. 1.

In the second embodiment, through calibration operation similar to that of Phase 1 to Phase 3 in the first embodiment, a high-precision step-down voltage (the voltage at the node Nn) is generated by the step-down voltage generation circuit 103 (first step-down voltage generation circuit). The step-down voltage generated is used as the reference voltage Vref, and the step-down voltage generation circuit 120 further generates the step-down voltage VDD2. Also, the step-down voltage generated in the first embodiment (the voltage at the node Nn) is supplied to the step-down voltage generation circuit 120, instead of to the load circuit 113. Below, differences from the first embodiment in the operation in Phase 1 to Phase 3 of the step-down power supply circuit of FIG. 8 are explained.

(Phase 1)

First, the inverting input terminal of the op-amp 104 is connected to the high-precision reference voltage source 101, the non-inverting input terminal is connected to the node Nn-2, and the step-down voltage generation circuit 103 generates the voltage at the node Nn, that is, the high-precision step-down voltage Vref. And, the step-down voltage generation circuit 120 takes this step-down voltage Vref as a reference voltage to generate the step-down voltage VDD2 from the external power supply voltage VDD1. At this time, in the step-down voltage generation circuit 120, the high-precision step-down voltage Vref corresponds to the reference voltage Vref of FIG. 1, and the voltage Vref at the node n1 is equal to the step-down voltage Vref. Hence, voltages at nodes n1 and n2 of the resistor string in the step-down voltage generation circuit 120 have high precision and the step-down voltage VDD2 at the node n2 also has high precision. Thus in Phase 1, the high-precision reference voltage source 101 is used to generate the step-down voltage VDD2.

(Phase 2)

Next, similarly to Phase 2 in the first embodiment, a search is performed for a node in the resistor string of the step-down voltage generation circuit 103 at which is equal to the reference voltage Vbias2. Further, during this search, the step-down voltage Vref is kept constant and at high precision. As a result, the voltages at each of the nodes of the resistor string of the step-down voltage generation circuit 120 are also kept constant and at high precision, so that the step-down voltage VDD2 is also kept at a constant and highly precise value.

(Phase 3)

After the search for the node in the resistor string with voltage equal to the reference voltage Vbias2 has been completed, similarly to Phase 3 in the first embodiment, the reference voltage of the step-down voltage generation circuit 103 is switched from the reference voltage Vbias1 of the high-precision reference voltage source 101 to the reference voltage Vbias2 of the calibrated reference voltage source 102, with low power consumption and low precision. Even after this switching is performed, the step-down voltage Vref is kept at a constant and high-precision value, so that the step-down voltage VDD2 is also kept at a constant and high-precision voltage value.

Thus in this second embodiment, the circuit group having the reference voltage source 101 and the step-down voltage generation circuit 103, and the circuit group having the calibrated reference voltage source 102 and the step-down voltage generation circuit 103 can be regarded as reference voltage sources to generate the step-down voltage VDD2. Specifically, in Phases 1 to 2, the circuit group having the reference voltage source 101 and the step-down voltage generation circuit 103 can be regarded as a reference voltage source which outputs a step-down voltage Vref with small variation, but which has high power consumption. Further, in Phase 3 the circuit group having the calibrated reference voltage source 102 and the step-down voltage generation circuit 103 can be regarded as a reference voltage source which outputs a step-down voltage Vref with small variation, and which has low power consumption.

Thus in the second embodiment, the circuit group having the reference voltage source 101 and the step-down voltage generation circuit 103, and the circuit group having the calibrated reference voltage source 102 and the step-down voltage generation circuit 103 function as reference voltage sources to generate the power supply for the load circuit 113 using the step-down voltage generation circuit 120. And, through the step-down power supply circuit illustrated in FIG. 8, the power consumption of the circuit group having the calibrated reference voltage source 102 and the step-down voltage generation circuit 103 as a reference voltage source can be reduced and a high-precision step-down voltage VDD2 can be generated. The voltages of each of the nodes in the resistor string of the step-down voltage generation circuit 120 are kept constant with high precision from Phase 1 to Phase 3, so that the high-precision step-down voltage VDD2 is stably generated. As a result, the step-down voltage VDD2 can be supplied to the calibration control circuit 108 including low-voltage elements.

Similarly to the first embodiment, in the method in Phase 2 of searching for the node in the resistor string at which the voltage is equal to the reference voltage Vbias2, switching may also be performed in the order from the switch SWn to the switch SW1, from higher to lower, or a bisection search method may be used.

Also, similarly to the first embodiment, the node in the resistor string from which the step-down voltage Vref is output may be any node from nodes N1 to Nn.

Also, similarly to the first embodiment, the node in the resistor string which is connected to the non-inverting input terminal of the op-amp 104 may be any one of the nodes Nn to N1.

Third Embodiment

Figure 9:
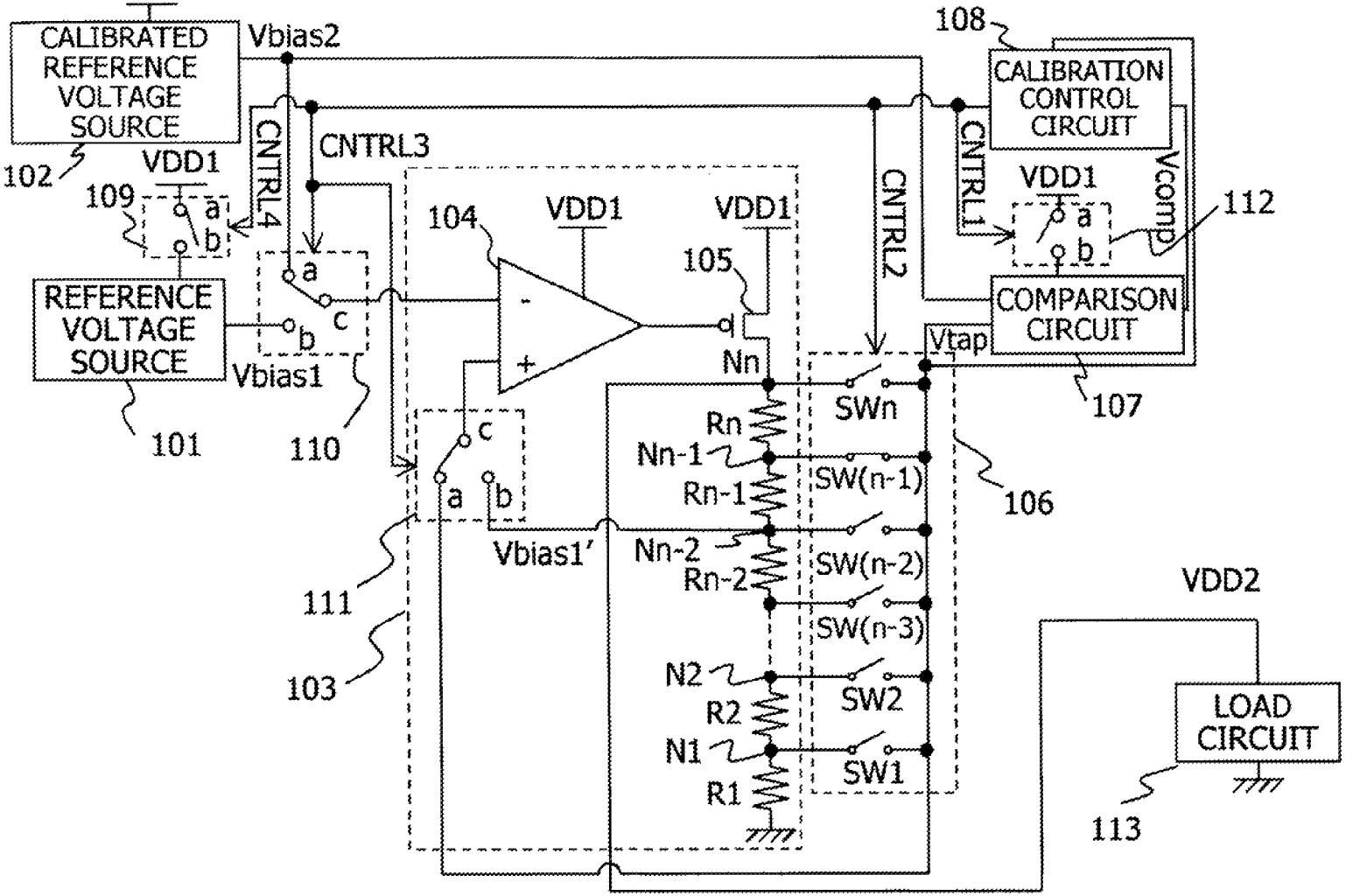
FIG. 9 illustrates the step-down power supply circuit of a third embodiment.

FIG. 9 illustrates the step-down power supply circuit of a third embodiment. Differing from the first embodiment, the common node voltage Vtap is supplied as the power supply voltage to the calibration control circuit 108 including low-voltage elements. When the voltages at each of the nodes in the resistor string of the step-down voltage generation circuit 103 are within the power supply voltage range allowed by the calibration control circuit 108, the third embodiment can be adopted. The step-down power supply circuit of FIG. 9 can also be operated similarly to the Phase 1 to Phase 3 of the first embodiment, to stably generate a high-precision step-down voltage VDD2 with low power consumption of the reference voltage source.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A step-down power supply circuit, comprising:

first and second reference voltage source circuits configured to generate prescribed reference voltages;

a first step-down voltage generation circuit, including a transistor to the source of which a first voltage is supplied, a resistor string in which a plurality of resistors are coupled in series and which is provided between the transistor and a second voltage, and an operational amplifier which controls the transistor, the first step-down voltage generation circuit generating a first step-down output voltage at a first node among a plurality of resistor-coupling nodes in the resistor string;

a plurality of switches, coupled to the plurality of resistor-coupling nodes respectively;

a comparison circuit configured to compare a voltage at a common node coupled in common by the plurality of switches with the output voltage of the second reference voltage source circuit, while the plurality of switches are switched; and a calibration control circuit configured to select any one among the plurality of switches according to a comparison result of the comparison circuit to perform a calibration, wherein the calibration control circuit, during a calibration operation of the first step-down voltage generation circuit, couples a second node among the plurality of resistor-coupling nodes to a non-inverting input terminal of the operational amplifier, and couples the output of the first reference voltage source circuit to an inverting input terminal of the operational amplifier; and, the calibration control circuit, after the calibration of the first step-down voltage generation circuit, couples the common node to the non-inverting input terminal of the operation amplifier, and couples the output of the second reference voltage source circuit to the inverting input terminal of the operational amplifier.

2. The step-down power supply circuit according to claim 1, wherein the first reference voltage source circuit outputs a first reference voltage, and the second reference voltage source circuit outputs a second reference voltage with variation greater than that of the first reference voltage.

3. The step-down power supply circuit according to claim 2, wherein the calibration control circuit selects one of the plurality of switches such that a difference between the common node voltage and the second reference voltage becomes smaller, according to the result of the comparison circuit.

4. The step-down power supply circuit according to claim 2, wherein the calibration control circuit is supplied with a power supply voltage of a third node from among the plurality of resistor-coupling nodes.

5. The step-down power supply circuit according to claim 4, wherein the third node is the first node.

6. The step-down power supply circuit according to claim 1, further comprising a second step-down voltage generation circuit configured to use the first step-down output voltage as a reference voltage and generates a second step-down output voltage from an external power supply voltage.

7. The step-down power supply circuit according to claim 6, wherein the calibration control circuit selects one of the plurality of switches such that a difference between the common node voltage and the second reference voltage becomes smaller, according to the result of the comparison circuit.

8. The step-down power supply circuit according to claim 6, wherein the calibration control circuit is supplied with the second step-down output voltage.

9. The step-down power supply circuit according to claim 1, wherein the calibration control circuit selects one of the plurality of switches such that a difference between the common node voltage and the second reference voltage becomes smaller, according to the result of the comparison circuit.

10. The step-down power supply circuit according to claim 9, wherein the calibration control circuit outputs a first control signal when a determination signal having the result of the comparison circuit has changed from a first logic level to a second logic level;

the step-down power supply circuit further comprising: a first switching circuit which in response to the first control signal switches a coupling of the inverting input terminal of the operational amplifier from the first reference voltage source circuit to the second reference voltage source circuit; and a second switching circuit which in response to the first control signal switches the coupling of the non-inverting input terminal of the operational amplifier from the second node to the common node.

11. The step-down power supply circuit according to claim 1, wherein the calibration control circuit is supplied with a power supply voltage of a third node from among the plurality of resistor-coupling nodes.

12. The step-down power supply circuit according to claim 11, wherein a third node is the first node.

13. The step-down power supply circuit according to claim 1, wherein the first reference voltage source circuit is supplied with an external power supply voltage, and after completion of calibration of the first step-down voltage generation circuit, the external power supply voltage is decoupled.

* * * * *